US005137686A

United States Patent [19]

Rioja et al.

[11] Patent Number: 5,137,686

[45] Date of Patent: Aug. 11, 1992

[54] ALUMINUM-LITHIUM ALLOYS

[75] Inventors: Roberto J. Rioja, Lower Burrell; Alex Cho, Monroeville; Edward L. Colvin, O'Hara Township, Allegheny County; Asuri K. Vasudevan, Plum Boro, all of Pa.

[73] Assignee: Aluminum Company of America, Pittsburgh, Pa.

[21] Appl. No.: 149,802

[22] Filed: Jan. 28, 1988

[51] Int. Cl.[5] ..... C22C 21/00; C22F 1/04

[52] U.S. Cl. ..... 420/528; 148/417; 148/437; 148/439; 148/693; 148/694; 420/532; 420/535

[58] Field of Search ..... 420/532, 533, 534, 535, 420/543, 544; 148/11.5 A, 12.7 A, 159, 417, 439, 437

[56] References Cited

U.S. PATENT DOCUMENTS

| | | | |
|---|---|---|---|
| 2,915,390 | 12/1959 | Criner | 75/141 |
| 4,094,705 | 6/1978 | Sperry et al. | 148/2 |
| 4,571,272 | 2/1986 | Grimes | 148/11.5 |
| 4,582,544 | 4/1986 | Grimes et al. | 148/11.5 |
| 4,603,029 | 7/1986 | Quist et al. | 420/535 |
| 4,626,409 | 12/1986 | Miller | 420/533 |
| 4,636,357 | 1/1987 | Peel et al. | 420/532 |
| 4,648,913 | 3/1987 | Hunt, Jr. et al. | 148/12.7 |

FOREIGN PATENT DOCUMENTS

| | | |
|---|---|---|
| 150456 | 12/1984 | European Pat. Off. . |
| 156995 | 10/1985 | European Pat. Off. . |
| 158769 | 10/1985 | European Pat. Off. . |
| 210112 | 6/1986 | European Pat. Off. . |
| 3613224 | 4/1986 | Fed. Rep. of Germany . |
| 8502416 | 11/1984 | PCT Int'l Appl. . |
| 1387586 | 3/1975 | United Kingdom . |
| 2127847 | 3/1986 | United Kingdom . |

OTHER PUBLICATIONS

"Microstructure and Toughness of High Strength Aluminum Alloys" by J. T. Staley, ASTM STP 605, pp. 71–103.

*Primary Examiner*—R. Dean
*Assistant Examiner*—Robert R. Koehler
*Attorney, Agent, or Firm*—Andrew Alexander

[57] ABSTRACT

Disclosed is an aluminum base alloy suitable for forming into a wrought product having improved combinations of strength, corrosion resistance and fracture toughness. The alloy is comprised of 0.2 to 5.0 wt. % Li, 0.05 to 6.0 wt. % Mg, at least 2.45 wt. % Cu, 0.01 to 0.16 wt. % Zr, 0.05 to 12 wt. % Zn, 0.5 wt. % max. Fe, 0.5 wt. % max. Si, the balance aluminum and incidental impurities.

56 Claims, 2 Drawing Sheets

STRENGTH / TOUGHNESS RELATIONSHIP

STRENGTH / AGING RELATIONSHIP

ALUMINUM-LITHIUM ALLOYS

BACKGROUND OF THE INVENTION

This invention relates to aluminum base alloys, and more particularly, it relates to improved lithium containing aluminum base alloys, products made therefrom and methods of producing the same.

In the aircraft industry, it has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium containing alloy have both improved fracture toughness and strength properties.

It will be appreciated that both high strength and high fracture toughness appear to be quite difficult to obtain when viewed in light of conventional alloys such as AA (Aluminum Association) 2024-T3X and 7050-TX normally used in aircraft applications. For example, a paper by J. T. Staley entitled "Microstructure and Toughness of High-Strength Aluminum Alloys", Properties Related to Fracture Toughness, ASTM STP605, American Society for Testing and Materials, 1976, pp. 71–103, shows generally that for AA2024 sheet, toughness decreases as strength increases. Also, in the same paper, it will be observed that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings. Thus, it will be appreciated that obtaining qualities such as high strength at little or no sacrifice in toughness, or where toughness can be controlled as the strength is increased would result in a remarkably unique aluminum-lithium alloy product.

U.S. Pat. No. 4,626,409 discloses aluminum base alloy consisting of, by wt. %, 2.3 to 2.9 Li, 0.5 to 1.0 Mg, 1.6 to 2.4 Cu, 0.05 to 0.25 Zr, 0 to 0.5 Ti, 0 to 0.5 Mn, 0 to 0.5 Ni, 0 to 0.5 Cr and 0 to 2.0 Zn and a method of producing sheet or strip therefrom. In addition, U.S. Pat. No. 4,582,254 discloses a method of superplastically deforming an aluminum alloy having a composition similar to that of U.S. Pat. No. 4,626,409. European Patent Application 210112 discloses an aluminum alloy product containing 1 to 3.5 wt. % Li, up to 4 wt. % Cu, up to 5 wt. % Mg, up to 3 wt. % Zn and Mn, Cr and/or Zr additions. The alloy product is recrystallized and has a grain size less than 300 micrometers. U.S. Pat. No. 4,648,913 discloses aluminum base alloy wrought product having improved strength and fracture toughness combinations when stretched, for example, an amount greater than 3%.

The present invention provides an improved lithium containing aluminum base alloys which permit products having improved strength characteristics while retaining high toughness properties.

SUMMARY OF THE INVENTION

A principal object of this invention is to provide an improved lithium containing aluminum base alloys.

Another object of this invention is to provide an improved aluminum-lithium alloy wrought product having improved corrosion resistance, strength and toughness characteristics.

And yet another object of this invention includes providing lithium containing aluminum base alloy suitable for forged products having improved strength and fracture toughness properties.

These and other objects will become apparent from the specification, drawings and claims appended hereto.

In accordance with these objects, an aluminum base alloy suitable for forming into a wrought product having improved corrosion resistance and combinations of strength and fracture toughness is provided. The alloy is comprised of 0.2 to 5.0 wt. % Li, 0.05 to 6.0 wt. % Mg, 2.45 to 2.95 wt. % Cu, 0.05 to 0.12 wt. % Zr, 0.05 to 12.0 wt. % Zn, 0.5 wt. % max. Fe, 0.5 wt. % max, Si, the balance aluminum and incidental impurities.

DETAILED DESCRIPTION OF THE PREFERRED EMBODIMENTS

Figure 1:
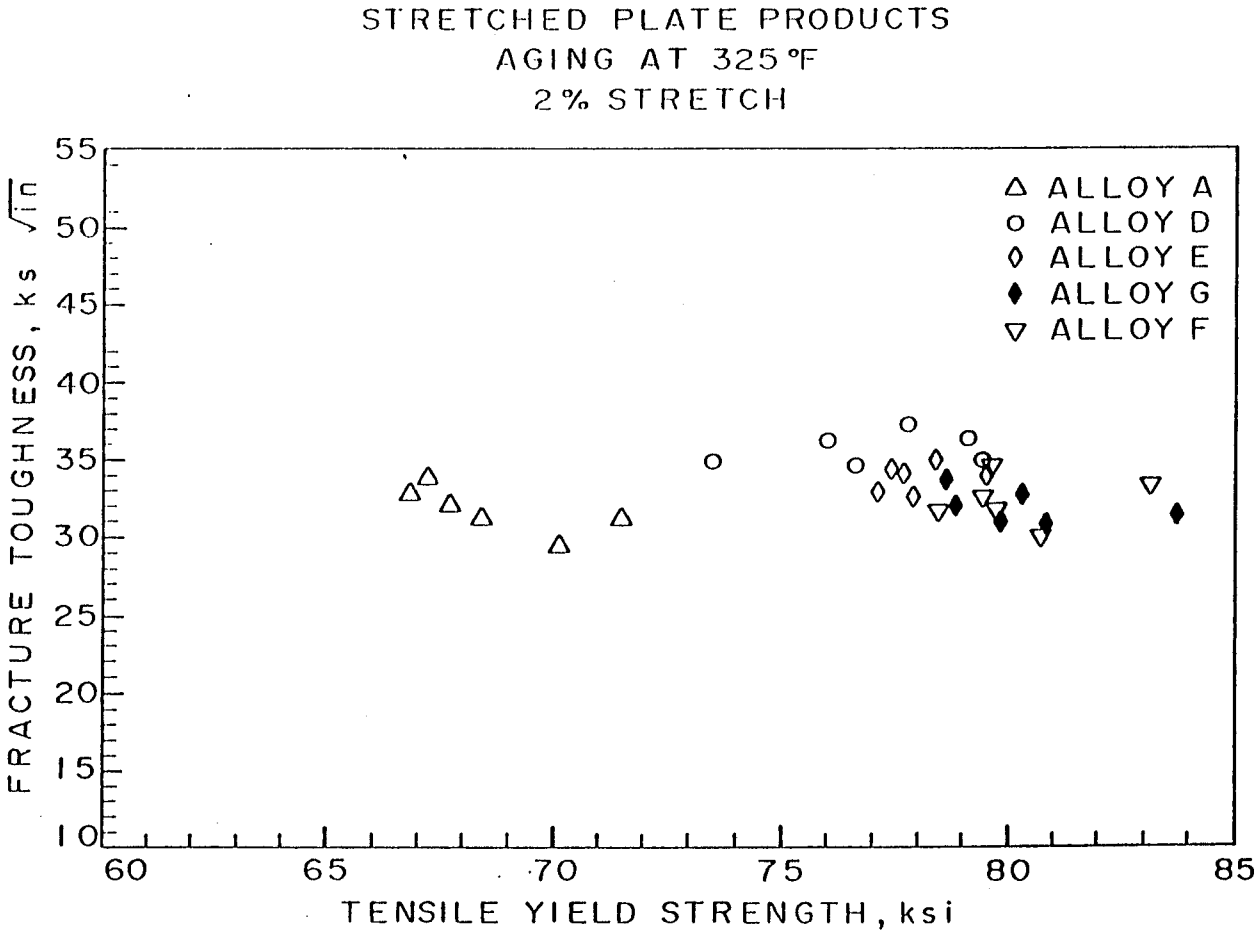
FIG. 1 shows a strength and fracture toughness plot of alloys in accordance with the invention.

The alloy of the present invention can contain 0.2 to 5.0 wt. % Li, 0.05 to 6.0 wt. % Mg, at least 2.45 wt. % Cu, 0.05 to 12 wt. % Zn, 0.01 to 0.14 wt. % Zr, 0.5 wt. % max. Fe, 0.5 wt. % max, Si, the balance aluminum and incidental impurities. The impurities are preferably limited to about 0.05 wt. % each, and the combination of impurities preferably should not exceed 0.35 wt. %. Within these limits, it is preferred that the sum total of all impurities does not exceed 0.15 wt. %.

A preferred alloy in accordance with the present invention can contain 1.5 to 3.0 wt. % Li, 2.5 to 2.95 wt. % Cu, 0.2 to 2.5 wt. % Mg, 0.2 to 11 wt. % Zn, 0.08 to 0.12 wt. % Zr, the balance aluminum and impurities as specified above. A typical alloy composition would contain 1.8 to 2.5 wt. % Li, 2.55 to 2.9 wt. % Cu, 0.2 to 2.0 wt. % Mg, 0.2 to 2.0 wt. % Zn, greater than 0.1 to less than 0.16 wt. % Zr, and max. 0.1 wt. % of each of Fe and Si.

A suitable alloy composition would contain 1.9 to 2.4 wt. % Li, 2.55 to 2.9 wt. % Cu, 0.1 to 0.6 wt. % Mg, 0.5 to 1.0 wt. % Zn, 0.08 to 0.12 wt. % Zr, max. 0.1 wt. % of each of Fe and Si, the remainder aluminum.

In the present invention, lithium is very important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density.

With respect to copper, particularly in the ranges set forth hereinabove for use in accordance with the present invention, its presence enhances the properties of the alloy product by reducing the loss in fracture toughness at higher strength levels. That is, as compared to lithium, for example, in the present invention copper has the capability of providing higher combinations of toughness and strength. Thus, in the present invention when selecting an alloy, it is important in making the selection to balance both the toughness and strength desired, since both elements work together to provide toughness and strength uniquely in accordance with the present invention. It is important that the ranges referred to hereinabove, be adhered to, particularly with respect to the limits of copper, since excessive amounts, for example, can lead to the undesirable formation of intermetallics which can interfere with fracture toughness. Typically, copper should be less than 3.0 wt. %; however, in a less preferred embodiment, copper can be increased to less than 4.0 wt. % and preferably less than 3.5 wt. %. The combination of lithium and copper should not exceed 5.5 wt. % with lithium being at least 1.5 wt. % with greater amounts of lithium being preferred.

Magnesium is added or provided in this class of aluminum alloys mainly for purposes of increasing strength although it does decrease density slightly and is advantageous from that standpoint. It is important to adhere to the limits set forth for magnesium because excess magnesium, for example, can also lead to interference with fracture toughness, particularly through the formation of undesirable phases at grain boundaries.

Zirconium is the preferred material for grain structure control; however, other grain structure control materials can include Cr, V, Hf, Mn, Ti, typically in the range of 0.05 to 0.2 wt. % with Hf and Mn up to typically 0.6 wt. %. The level of Zr used depends on whether a recrystallized or unrecrystallized structure is desired. The use of zinc results in increased levels of strength, particularly in combination with magnesium. However, excessive amounts of zinc can impair toughness through the formation of intermetallic phases.

Zinc is important because, in this combination with magnesium, it results in an improved level of strength which is accompanied by high levels of corrosion resistance when compared to alloys which are zinc free. Particularly effective amounts of Zn are in the range of 0.1 to 1.0 wt. % when the magnesium is in the range of 0.05 to 0.5 wt. %, as presently understood. It is important to keep the Mg and Zn in a ratio in the range of about 0.1 to less than 1.0 when Mg is in the range of 0.1 to 1. wt. % with a preferred ratio being in the range of 0.2 to 0.9 and a typical ratio being in the range of about 0.3 to 0.8. The ratio of Mg to Zn can range from 1 to 6 when the wt. % of Mg is 1 to 4.0 and Zn is controlled to 0.2 to 2.0 wt. %, preferably in the range of 0.2 to 0.9 wt. %

Working with the Mg/Zn ratio of less than one is important in that it side in the worked product being less anisotropic or being more isotropic in nature, i.e., properties more uniform in all directions. That is, working with the Mg/Zn ratio in the range of 0.2 to 0.8 can result in the end product having greatly reduced hot worked texture, resulting from rolling, for example, to provide improved properties, for example in the 45° direction.

Toughness or fracture toughness as used herein refers to the resistance of a body, e.g. extrusions, forgings, sheet or plate, to the unstable growth of cracks or other flaws.

The Mg/Zn ratio less than one is important for another reason. That is, keeping the Mg/Zn ratio less than one, e.g., 0.5, results not only in greatly improved strength and fracture toughness but in greatly improved corrosion resistance. For example, when the Mg and Zn content is 0.5 wt. % each, the resistance to corrosion is greatly lowered. However, when the Mg content is being 0.3 wt. % and the Zn is 0.5 wt. %, the alloys have a high level of resistance to corrosion.

While the inventors do not wish to be held to any theory of invention, it is believed that the resistance to exfoliation and the resistance to crack propagation under an applied stress increases as Zn is added. It is believed that this behavior is due to the fact that Zn stimulates the desaturation of Cu from the matrix solid solution be enhancing the precipitation of Cu-rich precipitates. This effect is believed to change the solution potential to higher electronegative values. It is also believed that Zn forms Mg-Zn bearing phases at the grain boundaries that interact with propagating cracks and blunt the crack tip or deflect the advancing crack and thereby improves the resistance crack propagation under an applied load.

As well as providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. Further, the alloy may be roll cast or slab cast to thicknesses from about 0.25 to 2 to 3 inches or more depending on the end product desired. It should be noted that the alloy may also be provided in billet form consolidation from fine particulate such as powdered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably subjected to homogenization, and preferably at metal temperatures in the range of 900° to 1050° F. for a period of time of at least one hour to dissolve soluble elements such as Li, Cu, Zn and Mg and to homogenize the internal structure of the metal. A preferred time period is about 20 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable.

After the homogenizing treatment, the metal can be rolled or extruded or otherwise subjected to working operations to produce stock such as sheet, plate or extrusions or other stock suitable for shaping into the end product. To produce a sheet or plate-type product, a body of the alloy is preferably hot rolled to a thickness ranging from 0.1 to 0.25 inch for sheet and 0.25 to 6.0 inches for plate. For hot rolling purposes, the temperature should be in the range of 1000° F. down to 750° F.

Preferably, the metal temperature initially is in the range of 850° to 975° F.

When the intended use of a plate product is for wing spars where thicker sections are used, normally operations other than hot rolling are unnecessary. Where the intended use is wing or body panels requiring a thinner gauge, further reductions as by cold rolling can be provided. Such reductions can be to a sheet thickness ranging, for example, from 0.010 to 0.249 inch and usually from 0.030 to 0.10 inch.

After working a body of the alloy to the desired thickness, the sheet or plate or other worked article is subjected to a solution heat treatment to dissolve soluble elements. The solution heat treatment is preferably accomplished at a temperature in the range of 900° to 1050° F. and preferably produces an unrecrystallized grain structure.

Solution heat treatment can be performed in batches or continuously, and the time for treatment can vary from hours for batch operations down to as little as a few seconds for continuous operations. Basically, solutionizing of the alloy into a single phase field can occur fairly rapidly, for instance in as little as 30 to 60 seconds, once the metal has reached a solution temperature of about 1000° to 1050° F. However, heating the metal to that temperature can involve substantial amounts of time depending on the type of operation involved. In bath treating a sheet product in a production plant, the sheet is treated in a furnace load and an amount of time can be required to bring the entire load to solution temperature, and accordingly, solution heat treating can consume one or more hours, for instance one or two hours or more in bath solution treating. In continuous treating, the sheet is passed continuously as a single web through an elongated furnace which greatly increases the heat-up rate. The continuous approach is favored in practicing the invention, especially for sheet products, since a relatively rapid heat up and short dwell time at solution temperature is obtained. Accordingly, the inventors contemplate solution heat treating in as little as about 1.0 minute. As a further aid to achieving a short heat-up time, a furnace temperature or a furnace zone temperature significantly above the desired metal temperature provides a greater temperature head useful in reducing heat-up times.

To further provide for the desired strength and fracture toughness, as well as corrosion resistance, necessary to the final product and to the operations in forming that product, the product should be quenched to prevent or minimize uncontrolled precipitation of strengthening phases referred to herein later.

After the alloy product of the present invention has been solution heat treated and quenched, it may be artificially aged to provide the combination of fracture toughness and strength which are so highly desired in aircraft members. This can be accomplished by subjecting the sheet or plate or shaped product to a temperature in the range of 150° to 400° F. for a sufficient period of time to further increase the yield strength. Some compositions of the product are capable of being artificially aged to a yield strength as high as 95 ksi. However, the useful strengths are in the range of 50 to 85 ksi and corresponding fracture toughnesses for plate products are in the range of 25 to 75 ksi in. Preferably, artificial aging is accomplished by subjecting the alloy product to a temperature in the range of 275° to 375° F. for a period of at least 30 minutes. A suitable aging practice contemplate a treatment of about 8 to 24 hours at a temperature of about 325° F. Further, it will be noted that the alloy product in accordance with the present invention may be subjected to any of the typical underaging treatments well known in the art, including natural aging and multi-step agings. Also, while reference has been made herein to single aging steps, multiple aging steps, such as two or three aging steps, ar contemplated and stretching or its equivalent working may be used prior to or even after part of such multiple aging steps.

Specific strength, as used herein is the tensile yield strength divided by the density of the alloy. Plate products, for example, made from alloys in accordance with the invention, have a specific strength of at least $0.75\times10^6$ ksi in$^3$/lb and preferably at least $0.80\times10^6$ ksi in$^3$/lb. The alloys have the capability of producing specific strengths as high as $1.00\times10^6$ ksi in$^3$/lb.

The wrought product in accordance with the invention can be provided either in a recrystallized grain structure form or an unrecrystallized grain structure form, depending on the type of thermomechanical processing used. When it is desired to have an unrecrystallized grain structure plate product, the alloy is hot rolled and solution heat treated, as mentioned earlier. If it is desired to provide a recrystallized plate product, then the Zr is kept to a very low level, e.g., less than 0.05 wt. %, and the thermomechanical processing is carried out at rolling temperatures of about 800° to 850° F. with the solution heat treatment as noted above. For unrecrystallized grain structure, Zr should be above 0.10 wt. % and the thermomechanical processing is as above except a heat-up rate of not greater than 5°F./min and preferably less than 1°F./min is used in solution heat treatment.

If recrystallized sheet is desired having low Zr, e.g., less than 0.1 wt. %, typically in the range of 0.05 to 0.08 Zr, the ingot is first hot rolled to slab gauge of about 2 to 5 inches as above. Thereafter, it is reheated to between 700° to 850° F. then hot rolled to sheet gauge. This is followed by an anneal at between 500° to 850° F. for 1 to 12 hours. The material is then cold rolled to provide at least a 25% reduction in thickness to provide a sheet product. The sheet is then solution heat treated, quenched stretched and aged as noted earlier. Where the Zr content is fairly substantial, such as about 0.12 wt. %, a recrystallized grain structure can be obtained if desired. Here, the ingot is hot rolled at a temperature in the range of 800° to 1000° F. and then annealed at a temperature of about 800° to 850° F. for about 4 to 16 hours. Thereafter, it is cold rolled to achieve a reduction of at least 25% in gauge. The sheet is then solution heat treated at a temperature in the range of 950° to 1020° F. using heat-up rates of not slower than about 10°F./min with typical heat-up rates being as fast as 200° F./min with faster heat-up rates giving finer recrystallized grain structure. The sheet may then be quenched, stretched and aged.

Wrought product, e.g., sheet, plate and forgings, in accordance with the present invention develop a solid state precipitate along the (100) family of planes. The precipitate is plate like and has a diameter in the range of about 50 to 100 Angstroms and a thickness of 4 to 20 Angstroms. The precipitate is primarily copper or copper-magnesium containing; that is, it is copper or copper-magnesium rich. These precipitates are generally referred to as GP zones and are referred to in a paper entitled "Early Stages of GP Zone Formation in Naturally Aged A1-4 Wt Pct Cu Alloys " by R. J. Rioja and D. E. Laughlin, *Metallurgical Transactions A*, Vol. 8A, Aug. 1977, pp. 1257–1261, incorporated herein by reference. It is believed that the precipitation of GP zones results from the addition of Mg and Zn which is believed to reduce solubility of Cu in the Al matrix. Further, it is believed that the Mg and Zn stimulate nucleation of this metastable strengthening precipitate. The number density of precipitates on the (100) planes per cubic centimeter ranges from $1\times10^{15}$ to $1\times10^{17}$ with a preferred range being higher than $1\times10^{15}$ and typically as high as $5\times10^{16}$. These precipitates aid in producing a high level of strength without losing fracture toughness, particularly if short aging times, e.g., 15 hours at 350° F., are used for unstretched products.

Figure 2:
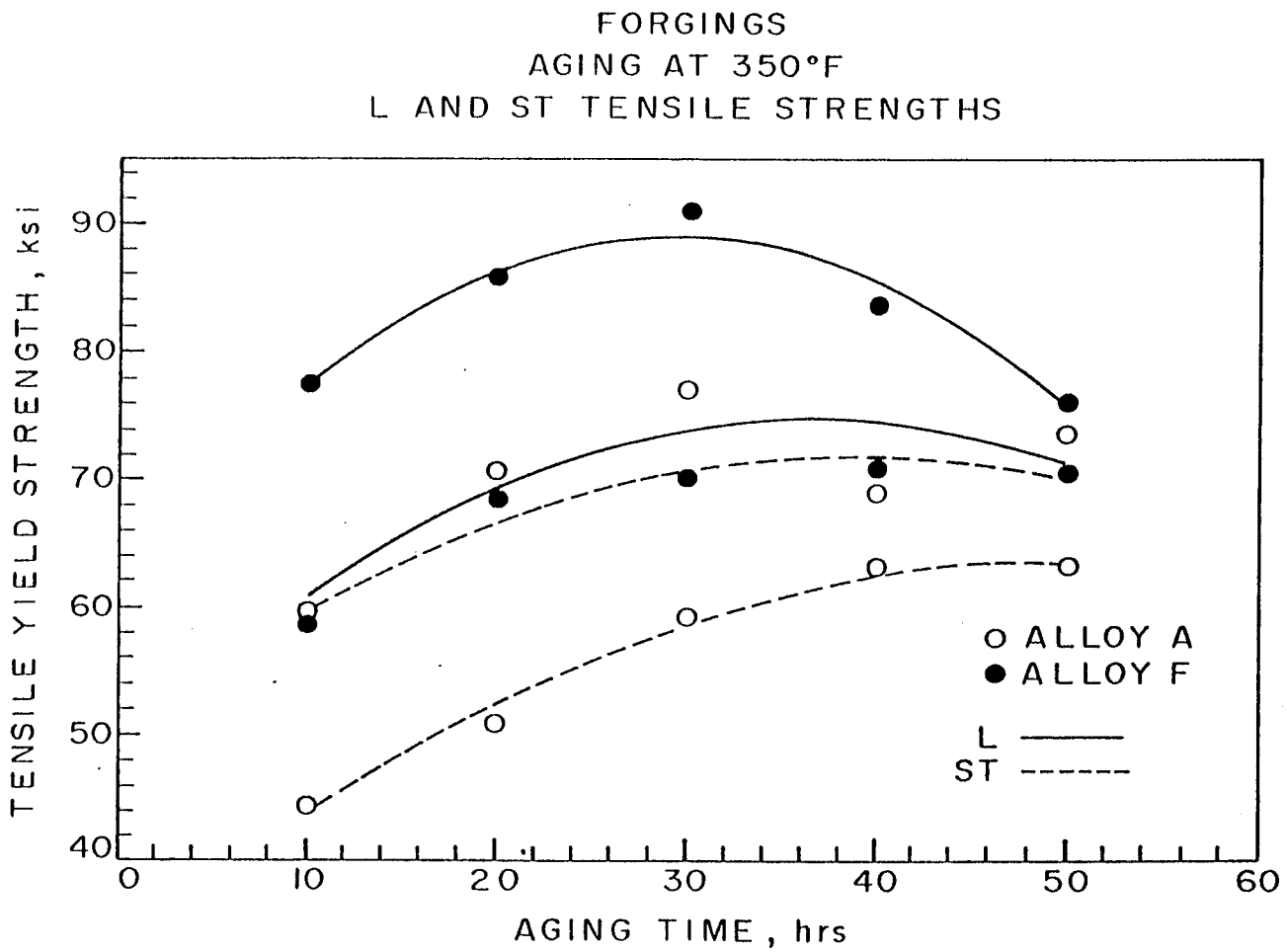
FIG. 2 shows strength plotted against aging time of an alloy in accordance with the invention.

The alloy of the present invention is useful also for extrusions and forgings with improved levels of mechanical properties, as shown in FIG. 2, for example. Extrusions and forgings are typically prepared by hot working at temperatures in the range of 600° to 1000° F., depending to some extent on the properties and microstructures desired.

The following examples are further illustrative of the invention:

EXAMPLE 1

The alloys of the invention (Table 1) in this Example were cast into ingot suitable for rolling. Alloy A corresponds to AA2090, Alloy B corresponds to AA2090 plus 0.3 wt. % Mg, and Alloy C corresponds to AA2090 plus 0.6 wt. % Mg. Alloys A, B and C were provided for comparative purposes. The ingots were then homogenized at 950° F. for 8 hours followed by 24 hours at 1000° F., hot rolled to 1 inch thick plate and solution heat treated for one hour at 1020° F. The specimens were quenched and aged. Other specimens were stretched 2% and 6% of their original length at room temperature and then artificially aged. Unstretched samples were aged at 350° F. Samples stretched 2% and 6% were aged at 325° F. Table 2 shows the highest attained specific strengths. Stretched and unstretched samples were also aged to measure corrosion performance. EXCO (ASTM G34) is a total immersion test designed to determine the exfoliation corrosion resistance of high strength 2XXX and 7XXX aluminum alloys. Table 3 shows that alloys E, F and G, which had ratios of Mg to Zn less than 1, performed better in the four day accelerated test than Alloys A, B, C and D which either contained no Zn (A, B, C) or had an Mg to Zn ratio of 1 (alloy D). Alloys A, B, C and D received many ratings of EC (severe exfoliation corrosion) or ED (very severe exfoliation). Alloy C suffered especially severe attack; all four samples received ED ratings after four days exposure to EXCO. Conversely, Alloys E, F and G received ratings that where predominantly EA (mild exfoliation) or EB (moderated exfoliation). Only one specimen from these three alloys was rated worse than EB. This was the 2% stretch 25 hours aging of Alloy E which was rated ED. This data indicates that Al-Cu-Li alloys with Mg to Zn ratios of less than 1 have improved resistance to exfoliation corrosion.

Tables 5, 6 and 7 list the strength and toughness exhibited by these alloys at 0, 2 and 6% stretch, respectively. FIG. 1 shows the properties of alloys E, F and G which exhibit improved combinations of corrosion resistance, strength and toughness.

TABLE 1

| Composition of the Seven Alloys in Weight Percent | | | | | | | | |
|---|---|---|---|---|---|---|---|---|
| Alloy | Cu | Li | Mg | Zn | Zr | Si | Fe | Al |
| A | 2.5 | 2.2 | 0 | 0 | 0.12 | 0.04 | 0.07 | Balance |
| B | 2.5 | 2.2 | 0.3 | 0 | 0.12 | 0.04 | 0.07 | Balance |
| C | 2.5 | 2.1 | 0.6 | 0 | 0.12 | 0.04 | 0.07 | Balance |
| D | 2.6 | 2.2 | 0.6 | 0.6 | 0.12 | 0.04 | 0.07 | Balance |
| E | 2.5 | 2.2 | 0.5 | 1 | 0.12 | 0.04 | 0.07 | Balance |
| F | 2.6 | 2.1 | 0.3 | 0.5 | 0.12 | 0.04 | 0.07 | Balance |
| G | 2.6 | 2.2 | 0.3 | 0.9 | 0.12 | 0.04 | 0.07 | Balance |

TABLE 2

| | Specific Tensile Yield Strengths ($\times 10^6$ KSI in$^3$/lb) | | | |
|---|---|---|---|---|
| Alloy | 0% Stretch | 2% Stretch | 6% Stretch | Calculated Density |
| A | 0.71 | 0.81 | 0.82 | 0.0909 |
| B | 0.80 | 0.82 | 0.88 | 0.0908 |
| C | 0.81 | 0.84 | 0.93 | 0.0910 |
| D | 0.79 | 0.89 | 0.93 | 0.0915 |
| E | 0.83 | 0.87 | 0.90 | 0.0913 |
| F | 0.81 | 0.85 | 0.92 | 0.0910 |
| G | 0.90 | 0.90 | 0.93 | 0.0912 |

EXAMPLE 2

The alloys of the invention in this example are the same as those from Example 1 except they were hot rolled to 1.5 inch thick plate rather than to 1 inch plate before they were solution heat treated for one hour at 1020 F. The specimens were quenched and artificially aged at 350° F. for 20 and 30 hours. Alloys E, F and G, which had ratios of Mg to Zn of less than 1, had better resistance to stress corrosion cracking (SCC) than Alloys A, B, C and D which either contained no Zn (A, B, C) or had a Zn to Mg ratio of 1 (Alloy D). The stress corrosion cracking test results are listed in Table 4 which also contains a description of the test procedures.

Alternate immersion testing in 3.5 wt. % NaCl solution (ASTM G44) is commonly used to evaluate the stress corrosion cracking performance of high strength aluminum alloys, per ASTM G47. It can be seen in the table that Alloys E, F and G have superior SCC resistance to the other four alloys since specimens from Alloys E, F and G have all survived 30 days in alternate immersion at 40,000 psi. One difference between the groups is the Mg to Zn ratio which is less than 1 (based on weight) and achieves high resistance to stress corrosion.

TABLE 3

| EXCO Ratings of Several Al—Li Alloys 1.0 Inch Thick Plate in T8 (Cold Work Prior to Aging) Temper | | | | | |
|---|---|---|---|---|---|
| Alloy | Stretch (%)* | Age (hr/°F.) | Tensile Yield Strength (Longitudinal) ksi | 2 Day | 4 Day |
| A | 2 | 25/325 | 66.8 | EC | ED |
| A | 2 | 35/325 | 71.5 | EC | EC |
| A | 6 | 15/325 | 68.4 | EA | EB |
| A | 6 | 20/325 | 72.4 | EA | EB |
| B | 2 | 25/325 | 73.7 | EB | EC |
| B | 2 | 35/325 | 73.5 | EB | EB |
| B | 6 | 15/325 | 75.7 | EC | EC |
| B | 6 | 20/325 | 78.0 | EC | EC |
| C | 2 | 25/325 | 73.9 | EC | ED |
| C | 2 | 35/325 | 77.6 | ED | ED |
| C | 6 | 15/325 | 78.0 | EC | ED |
| C | 6 | 20/325 | 81.5 | EC | ED |
| D | 2 | 25/325 | 77.8 | EB | EB |
| D | 2 | 35/325 | 73.5 | EB | EB |

TABLE 3-continued

EXCO Ratings of Several Al—Li Alloys
1.0 Inch Thick Plate in T8 (Cold Work Prior to Aging) Temper

| Alloy | Stretch (%)* | Age (hr/°F.) | Tensile Yield Strength (Longitudinal) ksi | 2 Day | 4 Day |
|---|---|---|---|---|---|
| D | 6 | 15/325 | 75.8 | EC | ED |
| D | 6 | 20/325 | 76.7 | EC | EC |
| E | 2 | 25/325 | 77.4 | EC | EC |
| E | 2 | 35/325 | 79.5 | EB | EB |
| E | 6 | 15/325 | 79.2 | EB | EB |
| E | 6 | 20/325 | 84.1 | EB | EB |
| F | 2 | 25/325 | 83.1 | EA | EA |
| F | 2 | 35/325 | 78.4 | EA | EA |
| F | 6 | 15/325 | 81.8 | EB | EB |
| F | 6 | 20/325 | 84.8 | EB | EB |
| G | 2 | 25/325 | 80.3 | EB | EB |
| G | 2 | 35/325 | 80.8 | EB | EB |
| G | 6 | 15/325 | 77.8 | EB | EB |
| G | 6 | 20/325 | 89.5 | EB | EB |

EXCO testing conducted per ASTM G34.
*In the unstretched condition, the alloys had a rating of EC or ED after four days.
EA = Mild Exfoliation
EB = Moderate Exfoliation
EC = Severe Exfoliation
ED = Very Severe Exfoliation

TABLE 4

Stress Corrosion Cracking Performance
of Several Al—Li Alloy Specimens
1.5 Inch Thick Plate in T6 Condition
(No Cold Work Prior to Aging)

| Alloy | Age (hr/°F.) | 25 KSI* F/N** | 25 KSI* Days*** | 40 KSI* F/N** | 40 KSI* Days*** |
|---|---|---|---|---|---|
| A | 20/350 | 1/3 | 3,11,11 | 3/3 | 1,2,2 |
| A | 30/350 | 1/3 | 9,11 | 3/3 | 2,3,6 |
| B | 20/350 | 2/3 | 8,15 | 3/3 | 1,2,2 |
| B | 30/350 | 0/3 | — | 2/3 | 1,6,7 |
| C | 20/350 | 3/3 | 1,1,1 | 2/2 | 1,1 |
| C | 30/350 | 2/2 | 1,1 | 1/1 | 1 |

TABLE 4-continued

Stress Corrosion Cracking Performance
of Several Al—Li Alloy Specimens
1.5 Inch Thick Plate in T6 Condition
(No Cold Work Prior to Aging)

| Alloy | Age (hr/°F.) | 25 KSI* F/N** | 25 KSI* Days*** | 40 KSI* F/N** | 40 KSI* Days*** |
|---|---|---|---|---|---|
| D | 20/350 | 1/3 | 2 | 3/3 | 1,3,3 |
| D | 30/350 | 1/3 | 3 | 2/3 | 6,2 |
| E | 20/350 | 0/3 | — | 0/3 | — |
| E | 30/350 | 0/3 | — | 0/3 | — |
| F | 20/350 | 0/3 | — | 0/3 | — |
| F | 30/350 | 0/3 | — | 0/3 | — |
| G | 20/350 | 0/3 | — | 0/3 | — |
| G | 30/350 | 0/3 | — | 0/3 | — |

One eighth inch diameter smooth tensile bars tested in 3.5 wt. % NaCl solution by alternate immersion for 30 days, per ASTM G44.
*Ksi = Thousand pounds per square inch.
**F/N = Number of specimens that failed/Number of specimens in test.
***Days = Days to failure.

EXAMPLE 3

This sample illustrates that forgings made from alloys of the present invention have improved combinations of corrosion resistance, strength and fracture toughness. The alloys in this Example are the same as those in Example 1 and the ingots were prepared also as in Example 1. Specimens were prepared from these ingots by hot extruding and forging.

The forged specimens were solution heat treated for one hour at 1020° F. then artificially aged at 350° F. for 20 and 40 hours. Alloys E, F and G, which had ratios of Mg to Zn of less than 1, had better resistance to stress corrosion cracking (SCC) than Alloys A, B, C and D which either contained no Zn (A, B, C) or had an Mg to Zn ratio of 1 (Alloy D). Alloys E, F and G all survived 20 days in alternate immersion at 40,000 psi. The stress corrosion cracking results are listed in Table 8. The strength and fracture toughness are shown in Table 9.

TABLE 5

Plate (1" Thick) Tensile Properties at 0% Stretch

| Alloy | Aged 25 hr. at 350° F. Tensile Yield Strength+ | Ultimate Tensile Strength+ | % Elongation | Fracture Toughness‡ | Aged 30 hr. at 350° F. Tensile Yield Strength+ | Ultimate Tensile Strength+ | % Elongation | Fracture Toughness‡ | Aged 35 hr. at 350° F. Tensile Yield Strength+ | Ultimate Tensile Strength+ | % Elongation | Fracture Toughness‡ |
|---|---|---|---|---|---|---|---|---|---|---|---|---|
| A | 55.8 | 67.0 | 4.0 | 34.6 | 58.0 | 67.9 | 5.0 | 30.2 | 62.3 | 71.1 | 5.0 | 32.3 |
| A | 58.0 | 68.4 | 4.0 | 33.0 | 60.3 | 70.3 | 7.0 | 34.5 | 62.5 | 72.3 | 5.0 | 33.5 |
| B | 65.6 | 75.4 | 4.0 | 33.0 | 78.8 | 77.8 | 6.0 | 26.2 | 66.6 | 76.7 | 6.0 | 30.6 |
| B | 63.1 | 74.1 | 5.0 | 31.7 | 68.8 | 78.2 | 5.0 | 33.1 | 71.4 | 79.6 | 5.0 | 29.9 |
| C | 72.2 | 84.6 | 8.0 | 30.0 | 73.5 | 84.9 | 8.0 | 29.3 | 74.0 | 85.5 | 9.0 | 28.1 |
| C | 74.4 | 87.4 | 8.0 | 30.4 | 73.0 | 85.1 | 8.0 | 25.9 | 73.7 | 85.0 | 8.0 | 29.6 |
| D | 71.5 | 82.6 | 8.0 | 35.8 | 72.1 | 81.7 | 7.0 | 32.0 | 71.3 | 81.7 | 7.0 | 31.1 |
| D | 72.9 | 83.7 | 8.0 | 30.6 | 73.3 | 83.1 | 8.0 | 31.5 | 71.5 | 81.8 | 9.0 | 32.1 |
| E | 75.6 | 86.6 | 8.0 | 29.7 | 73.2 | 83.4 | 8.0 | 29.9 | 75.4 | 85.0 | 8.0 | 29.5 |
| E | 75.7 | 86.3 | 7.0 | 31.9 | 75.4 | 83.8 | 9.0 | 31.0 | 73.3 | 83.5 | 8.0 | 28.7 |
| F | 67.3 | 77.4 | 7.0 | 28.9 | 70.3 | 78.6 | 5.0 | 27.4 | 70.3 | 78.6 | 8.0 | 24.7 |
| F | 73.1 | 80.4 | 6.0 | 29.1 | 70.0 | 78.2 | 7.0 | 29.8 | 72.5 | 80.2 | 5.0 | 26.3 |
| G | 69.2 | 80.1 | 5.0 | 29.0 | 70.7 | 80.1 | 7.0 | 25.7 | 71.7 | 81.1 | 7.0 | 26.4 |
| G | 69.9 | 80.1 | 7.0 | 30.3 | 71.3 | 80.2 | 7.0 | 26.3 | 73.9 | 82.3 | 8.0 | 26.1 |

+ ksi

‡ ksi $\sqrt{\text{in.}}$

TABLE 6

| Alloy | Plate (1" Thick) Tensile Properties at 2% Stretch: Aged 25 hr. at 325° F. Tensile Yield Strength+ | Ultimate Tensile Strength+ | % Elongation | Fracture Toughness‡ | Aged 30 hr. at 325° F. Tensile Yield Strength+ | Ultimate Tensile Strength+ | % Elongation | Fracture Toughness‡ | Aged 35 hr. at 325° F. Tensile Yield Strength+ | Ultimate Tensile Strength+ | % Elongation | Fracture Toughness‡ |
|---|---|---|---|---|---|---|---|---|---|---|---|---|
| A | 66.8 | 75.6 | 8.0 | 33.0 | 67.7 | 76.0 | 7.0 | 32.2 | 71.5 | 77.9 | 10.0 | 31.1 |
| A | 67.2 | 75.6 | 10.0 | 34.0 | 68.4 | 76.9 | 10.0 | 31.4 | 70.1 | 77.4 | 10.0 | 29.8 |
| B | 73.7 | 79.8 | 8.0 | 36.2 | 74.3 | 80.4 | 9.0 | 36.0 | 73.5 | 80.7 | 8.0 | 35.3 |
| B | 76.0 | 83.1 | 8.0 | 36.2 | 76.3 | 82.5 | 7.0 | 34.8 | 73.2 | 80.1 | 7.0 | 33.4 |
| C | 73.9 | 83.0 | 9.0 | 35.6 | 76.4 | 84.3 | 8.0 | 33.8 | 77.6 | 84.8 | 8.0 | 34.9 |
| C | 75.6 | 83.9 | 7.0 | 35.0 | 76.6 | 84.5 | 7.0 | 35.7 | 78.5 | 86.2 | 8.0 | 33.8 |
| D | 77.8 | 84.9 | 8.0 | 37.2 | 79.4 | 86.1 | 9.0 | 34.8 | 73.5 | 80.9 | 7.0 | 34.7 |
| D | 76.6 | 84.5 | 7.0 | 34.5 | 79.1 | 86.5 | 7.0 | 36.2 | 76.0 | 83.1 | 7.0 | 36.1 |
| E | 77.4 | 86.6 | 7.0 | 34.3 | 77.7 | 86.7 | 8.0 | 33.9 | 79.5 | 87.6 | 6.0 | 33.9 |
| E | 78.4 | 87.4 | 7.0 | 34.9 | 77.9 | 86.8 | 7.0 | 32.5 | 77.1 | 85.8 | 7.0 | 32.8 |
| F | 83.1 | 88.1 | 7.0 | 33.0 | 79.4 | 85.5 | 9.0 | 32.2 | 78.4 | 85.2 | 7.0 | 31.3 |
| F | 79.5 | 84.8 | 8.0 | 34.2 | 79.7 | 85.3 | 8.0 | 31.4 | 80.7 | 87.3 | 8.0 | 29.0 |
| G | 80.3 | 86.3 | 8.0 | 32.5 | 79.8 | 86.1 | 7.0 | 30.8 | 80.8 | 85.8 | 6.0 | 30.6 |
| G | 78.6 | 85.3 | 9.0 | 33.5 | 83.7 | 89.1 | 7.0 | 31.2 | 78.8 | 84.7 | 8.0 | 31.8 |

+ksi

‡ksi $\sqrt{\text{in.}}$

TABLE 7

| Alloy | Plate (1" Thick) Tensile Properties at 6% Stretch: Aged 15 hr. at 325° F. Tensile Yield Strength | Ultimate Tensile Strength | % Elongation | Fracture Toughness | Aged 20 hr. at 325° F. Tensile Yield Strength | Ultimate Tensile Strength | % Elongation | Fracture Toughness | Aged 25 hr. at 325° F. Tensile Yield Strength | Ultimate Tensile Strength | % Elongation | Fracture Toughness |
|---|---|---|---|---|---|---|---|---|---|---|---|---|
| A | 68.4 | 75.2 | 9.0 | 34.4 | 72.4 | 78.4 | 8.0 | 31.6 | 73.4 | 79.1 | 9.0 | 29.7 |
| A | 68.0 | 74.9 | 9.0 | 33.3 | 72.7 | 78.2 | 8.0 | 30.7 | 73.3 | 79.1 | 12.0 | 31.6 |
| B | 75.7 | 81.8 | 6.0 | 39.7 | 78.0 | 83.5 | 7.0 | 36.0 | 80.4 | 84.2 | 8.0 | 37.5 |
| B | 75.1 | 81.5 | 6.0 | 36.8 | 77.0 | 81.9 | 8.0 | 39.7 | 80.3 | 84.5 | 8.0 | 38.0 |
| C | 78.0 | 85.3 | 7.0 | 35.3 | 81.5 | 88.6 | 9.0 | 37.5 | 84.5 | 89.9 | 8.0 | 35.8 |
| C | 77.4 | 85.2 | 8.0 | 37.3 | 82.7 | 87.9 | 7.0 | 35.6 | 84.2 | 89.3 | 8.0 | 34.2 |
| D | 75.8 | 83.2 | 9.0 | 37.3 | 76.7 | 83.6 | 6.0 | 38.1 | 81.3 | 86.6 | 8.0 | 33.7 |
| D | 74.1 | 81.7 | 7.0 | 36.5 | 77.9 | 84.9 | 7.0 | 35.4 | 82.2 | 87.9 | 6.0 | 34.3 |
| E | 79.2 | 85.5 | 7.0 | 39.5 | 84.1 | 88.1 | 5.0 | 36.6 | 85.1 | 88.3 | 6.0 | 34.0 |
| E | 79.4 | 86.2 | 7.0 | 38.0 | 84.8 | 89.6 | 9.0 | 36.4 | 85.0 | 89.4 | 6.0 | 34.9 |
| F | 81.8 | 86.9 | 6.0 | 34.8 | 84.8 | 86.8 | 9.0 | 31.2 | 82.2 | 86.6 | 7.0 | 34.7 |
| F | 81.6 | 86.8 | 9.0 | 37.0 | 81.5 | 88.6 | 8.0 | 36.0 | 81.8 | 87.8 | 7.0 | 32.5 |
| G | 77.8 | 83.3 | 6.0 | 33.9 | 89.5 | 86.6 | 7.0 | 34.0 | 80.9 | 85.6 | 6.0 | 32.7 |
| G | 80.7 | 86.3 | 7.0 | 33.6 | 79.6 | 84.8 | 7.0 | 32.8 | 79.4 | 84.3 | 7.0 | 33.7 |

+ksi

‡ksi $\sqrt{\text{in.}}$

TABLE 8

Stress Corrosion Cracking Results for Die Forgings Short Transverse Properties

| Alloy | Age (hr/°F.) | 25 ksi* F/N** | 25 ksi* Days*** | 40 ksi* F/N** | 40 ksi* Days*** |
|---|---|---|---|---|---|
| A | 20/350 | 3/3 | 1,1,4 | 3/3 | 1,2,2 |
| A | 40/350 | 3/3 | 4,7,12 | 3/3 | 2,3,4 |
| B | 20/350 | 2/3 | 7,15 | 3/3 | 4,11,11 |
| B | 40/350 | 3/3 | 1,3,3 | 3/3 | 1,1,1 |
| C | 20/350 | 3/3 | 1,3,2 | 3/3 | 1,1,1 |
| C | 40/350 | 3/3 | 1,3,3 | 3/3 | 1,1,1 |
| D | 20/350 | 0/3 | — | 3/3 | 1,2,7 |
| D | 40/350 | 0/3 | — | 1/3 | 6 |
| E | 20/350 | 0/3 | — | 0/3 | — |
| E | 40/350 | 0/3 | — | 1/3 | 25 |

TABLE 8-continued

Stress Corrosion Cracking Results for Die Forgings Short Transverse Properties

| Alloy | Age (hr/°F.) | 25 ksi* F/N** | 25 ksi* Days*** | 40 ksi* F/N** | 40 ksi* Days*** |
|---|---|---|---|---|---|
| F | 20/350 | 0/3 | — | 0/3 | — |
| F | 40/350 | 0/3 | — | 0/3 | — |
| G | 20/350 | 0/3 | — | 0/3 | — |
| G | 40/350 | 0/3 | — | 0/3 | — |

One eighth inch diameter smooth tensile bars tested in 3.5 wt. % NaCl solution by alternate immersion for 30 days, per ASTM G44.
*Ksi = Thousand pounds per square inch.
**F/N = Number of specimens that failed/Number of specimens in test.
***Days = Days to failure.

TABLE 9

| Alloy | Forging Properties (L, LT): Aged 20 hr. at 350° F. Tensile Yield Strength+ | Ultimate Tensile Strength+ | % Elongation | Fracture Toughness‡ | Aged 30 hr. at 350° F. Tensile Yield Strength+ | Ultimate Tensile Strength+ | % Elongation | Fracture Toughness‡ | Aged 40 hr. at 350° F. Tensile Yield Strength+ | Ultimate Tensile Strength+ | % Elongation | Fracture Toughness‡ |
|---|---|---|---|---|---|---|---|---|---|---|---|---|
| A | 65.2 | 70.1 | 7.1 | 35.2 | 68.3 | 75.4 | 4.0 | 32.7 | 70.9 | 78.9 | 4.0 | 30.0 |
| A | 67.7 | 74.3 | 4.0 | 37.9 | 69.2 | 74.1 | 4.0 | 28.6 | 76.2 | 81.8 | 8.6 | — |

TABLE 9-continued

| Alloy | Forging Properties (L, LT) Aged 20 hr. at 350° F. Tensile Yield Strength+ | Ultimate Tensile Strength+ | % Elongation | Fracture Toughness‡ | Aged 30 hr. at 350° F. Tensile Yield Strength+ | Ultimate Tensile Strength+ | % Elongation | Fracture Toughness‡ | Aged 40 hr. at 350° F. Tensile Yield Strength+ | Ultimate Tensile Strength+ | % Elongation | Fracture Toughness‡ |
|---|---|---|---|---|---|---|---|---|---|---|---|---|
| B | 81.6 | 88.1 | 5.0 | 42.6 | 77.4 | 83.6 | 6.0 | 30.9 | 86.4 | 90.6 | 6.0 | 19.2 |
| B | 80.7 | 87.8 | 5.0 | 37.6 | 79.4 | 85.2 | 8.0 | 22.5 | 82.1 | 87.8 | 6.0 | — |
| C | 82.8 | 88.2 | 8.0 | 29.1 | 84.0 | 90.1 | 8.0 | 15.5 | 81.5 | 86.6 | 8.0 | 24.4 |
| C | 85.7 | 90.9 | 6.0 | 10.9 | 82.7 | 85.8 | 8.0 | 10.3 | 83.8 | 88.6 | 7.0 | — |
| D | 81.8 | 86.8 | 6.0 | 27.0 | 88.3 | 91.9 | 6.0 | 22.7 | 80.2 | 86.0 | 6.0 | 21.1 |
| D | 81.4 | 85.1 | 4.0 | 28.0 | 89.8 | 92.4 | 5.0 | — | 82.3 | 86.7 | 5.0 | — |
| E | 78.8 | 85.9 | 8.0 | 27.7 | 81.6 | 87.3 | 5.0 | 24.1 | 82.4 | 87.4 | 6.0 | 24.1 |
| E | 85.2 | 80.9 | 7.0 | 24.4 | 85.5 | 89.8 | 7.0 | 25.5 | 84.5 | 88.8 | 6.0 | — |
| F | 77.8 | 83.8 | 6.0 | 21.6 | 83.2 | 87.6 | 4.0 | 15.2 | 83.0 | 88.1 | 5.0 | 16.7 |
| F | 76.8 | 83.9 | 5.0 | 20.1 | 80.2 | 87.8 | 5.0 | 16.3 | 89.2 | 93.7 | 6.0 | — |
| G | 87.0 | 87.9 | 5.0 | 28.5 | 87.1 | 92.2 | 5.0 | 36.0 | 81.7 | 87.0 | 6.0 | 29.3 |
| G | 78.4 | 85.9 | 5.0 | 25.9 | 86.6 | 91.6 | 5.0 | 28.5 | 82.8 | 88.7 | 5.0 | — |

+ ksi

‡ ksi $\sqrt{\text{in.}}$

While the invention has been described in terms of preferred embodiments, the claims appended hereto are intended to encompass other embodiments which fall within the spirit of the invention.

What is claimed is:

1. An aluminum base alloy suitable for forming into a wrought product having improved combinations of strength, corrosion resistance and fracture toughness, the alloy consisting essentially of 0.2 to 5.0 wt. % Li, 0.05 to 2.0 wt. % Mg, at least 2.45 wt. % Cu, 0.05 2.0 wt. % Zn, 0.5 wt. % max. Fe, 0.5 wt. % max. Si, at least one of the elements selected from the group Cr, V, Hf, Mn, Ti and Zr, with Cr, V, Ti and Zr in the range of 0.01 to 0.2 wt. % and Hf and Mn up to 0.6 wt. % each, Mg and Zn maintained in a ratio in the range of 0.1 to less than 1, the balance aluminum and incidental impurities.

2. The alloy in accordance with claim 1 wherein Li is in the range of 1.5 to 3.0 wt. %.

3. The alloy in accordance with claim 1 wherein Li is in the range of 1.8 to 2.5 wt. %.

4. The alloy in accordance with claim 1 wherein Mg is in the range of 0.2 to 2.0 wt. %.

5. The alloy in accordance with claim 1 wherein Zn is in the range of 0.2 to 2.0 wt. %.

6. The alloy in accordance with claim 1 wherein Zr is in the range of 0.05 to 0.12 wt. %.

7. The alloy in accordance with claim 1 wherein Cu is in the range of 2.55 to 2.90 wt. %.

8. An aluminum base alloy suitable for forming into a wrought product having improved combinations of strength and fracture toughness, the alloy consisting essentially of 1.8 to 2.5 wt. % Li, 0.2 to 2.9 wt. % Mg, 2.5 to 2.9 wt. % Cu, 0.08 to 0.12 wt. % Zr, 0.2 to 2.0 wt. % Zn, 0.5 wt. % max. Fe, 0.5 wt. % max. Si, Mg and Zn maintained in a ratio in the range of 0.1 to less than 1, the balance aluminum and incidental impurities.

9. An aluminum base alloy suitable for forming into a wrought product having improved combinations of strength and fracture toughness, the alloy consisting essentially of 1.9 to 2.4 wt. % Li, 0.1 to 0.6 wt. % Mg, 2.5 to 3.0 wt. % Cu, 0.08 to 0.12 wt. % Zr, 0.5 to 1.0 wt. % Zn, 0.5 wt. % max. Fe, 0.5 wt. % max. Si, Mg and Zn maintained in a ratio in the range of 0.1 to less than 1, the balance aluminum and incidental impurities.

10. A product in accordance with claim 9 wherein the product has a solid state plate-shaped precipitate in the family of 1,0,0 planes, the alloy product developing a number density of precipitates per cubic centimeter of at least $1.0\times10^{15}$ in an unstretched condition prior to aging and having a specific strength of greater than $0.75\times10^{6}$ ksi in$^3$/lb.

11. A lithium containing aluminum base Cu, Mg, Zn alloy product having improved combinations of strength and fracture toughness, the alloy consisting essentially of 0.2 to 5.0 wt. % Li, 0.05 to 2.0 wt. % Mg, at least 2.45 wt. % Cu, 0.05 to 2.0 wt. % Zn, 0.5 wt. % max. Fe, 0.5 wt. % max. Si, at least one of the elements selected from the group Cr, V, Hf, Mn, Ti and Zr, with Cr, V, Ti and Zr in the range of 0.01 to 0.2 wt. % and Hf and Mn up to 0.6 wt. % each, Mg and Zn maintained in a ratio in the range of 0.1 to less than 1, the balance aluminum and incidental impurities, the alloy product having a solid state plate-shaped precipitate in the family of 1,0,0 planes, the alloy product having a number density of precipitates per cubic centimeter in the range of $1\times10^{16}$ to $5.6\times10^{16}$ and having a specific tensile yield strength of greater than $0.8\times10^{6}$ ksi in$^3$/lb.

12. A lithium containing aluminum base Cu, Mg, Zn alloy product having improved combinations of strength and fracture toughness, the alloy consisting essentially of 1.9 to 2.4 wt. % Li, 0.1 to 0.6 wt. % Mg, 2.5 to 3.0 wt. % Cu, 0.5 to 1.0 wt. % Zn, 0.5 wt. % max. Fe, 0.5 wt. % max. Si, at least one of the elements selected from the group Cr, V, Hf, Mn, Ti and Zr, with Cr, V, Ti and Zr in the range of 0.01 to 0.2 wt. % and Hf and Mn up to 0.6 wt. % each, Mg and Zn maintained in a ratio in the range of 0.1 to less than 1, the balance aluminum and incidental impurities, the alloy product having a solid state plate-shaped precipitate in the family of 1,0,0 planes, the alloy product having a number density of precipitate per cubic centimeter in the range of $1\times10^{16}$ to $5.6\times10^{16}$ and having a specific strength of greater than $0.8\times10^{6}$ ksi in$^3$/lb.

13. The alloy in accordance with claim 11 wherein Li is in the range of 1.5 to 3.0 wt. %.

14. The alloy in accordance with claim 11 wherein Li is in the range of 1.8 to 2.5 wt. %.

15. The alloy in accordance with claim 11 wherein Mg is in the range of 0.2 to 2.0 wt. %.

16. The alloy in accordance with claim 11 wherein Zn is in the range of 0.2 to 2.0 wt. %.

17. The alloy in accordance with claim 11 wherein Zr is in the range of 0.08 to 0.12 wt. %.

18. The alloy in accordance with claim 11 wherein Cu is in the range of 2.55 to 2.90 wt. %.

19. The alloy product in accordance with claim 11 having an Mg-Zn ratio of 0.1 to less than 1.0 when Mg is in the range of 0.1 to 1.0 wt. %.

20. The alloy product in accordance with claim 11 having an Mg-Zn ratio of 0.2 to 0.9.

21. The alloy product in accordance with claim 11 having an Mg-Zn ratio of 0.3 to 0.8.

22. A lithium containing aluminum base Cu, Mg, Zn alloy product having improved combinations of strength and fracture toughness, the alloy consisting essentially of 1.5 to 3.0 wt. % Li, 0.2 to 2.0 wt. % Mg, 2.55 to 2.90 wt. % Cu, 0.05 to 0.12 wt. % Zr, 0.2 to 2.0 wt. % Zn, 0.5 wt. % max. Fe, 0.5 wt. % max. Si, Mg and Zn maintained in a ratio in the range of 0.1 to less than 1, the balance aluminum and incidental impurities, the alloy product having a solid state plate-shaped precipitate in the family of 1,0,0 planes, the alloy product having a number density of precipitates per cubic centimeter in the range of $1\times10^{16}$ to $5.6\times10^{16}$ and having a specific tensile yield strength of greater than $0.8\times10^{6}$ ksi $in^3/lb$.

23. A lithium containing aluminum base Cu, Mg, Zn alloy product having improved combinations of strength and fracture toughness, the alloy consisting essentially of 1.8 to 2.5 wt. % Li, 0.2 to 2.0 wt. % Mg, 2.5 to 2.9 wt. % Cu, 0.08 to 0.12 wt. % Zr, 0.2 to 2.0 wt. % Zn, 0.5 wt. % max. Fe, 0.5 wt. % max. Si, the balance aluminum and incidental impurities, the alloy having an Mg-Zn ratio of 0.2 to 0.8 inches and having a solid state plate-shaped precipitate in the family of 1,0,0 planes, the alloy product having a number density of precipitates per cubic centimeter in the range of $1\times10^{16}$ to $5.6\times10^{16}$ and having a specific tensile yield strength of greater than $0.8\times10^{6}$ ksi $in^3/lb$.

24. The alloy product in accordance with claim 11 wherein the product is a recrystallized sheet product.

25. The alloy product in accordance with claim 11 wherein the product is an unrecrystallized product.

26. The alloy product in accordance with claim 11 wherein the product is a recrystallized plate product.

27. The alloy product in accordance with claim 11 wherein the product is an unrecrystallized plate product.

28. A method of producing an unrecrystallized aluminum-lithium wrought product having improved levels of strength, fracture toughness and corrosion resistance, the method comprising the steps of:

(a) providing a body of a lithium containing aluminum base alloy consisting essentially of 0.2 to 5.0 wt. % Li, 0.05 to 2.0 wt. % Mg, at least 2.45 wt. % Cu, 0.05 to 2.0 wt. % Zn, 0.5 wt. % max. Fe, 0.5 wt. % max. Si, at least one of the elements selected from the group Cr, V, Hf, Mn, Ti and Zr, with Cr, V, Ti and Zr in the range of 0.01 to 0.2 wt. % and Hf and Mn up to 0.6 wt. % each, Mg and Zn maintained in a ratio in the range of 0.1 to less than 1, the balance aluminum and incidental elements and impurities;

(b) heating the body to a hot working temperature;

(c) hot working the body to provide a wrought product; and (d) solution heat treating, quenching and aging said product to provide a substantially unrecrystallized product having improved levels of strength and fracture toughness.

29. The method in accordance with claim 28 wherein hot rolling is performed at a temperature in the range of 750° to 1000° F.

30. The method in accordance with claim 28 wherein the hot rolling is performed at a temperature in the range of 850° to 975° F.

31. The method in accordance with claim 28 wherein the plate product is solution heat treated at a temperature in the range of 900° to 1050° F.

32. The alloy in accordance with claim 28 wherein Li is in the range of 1.5 to 3.0 wt. %.

33. The alloy in accordance with claim 28 wherein Li is in the range of 1.8 to 2.5 wt. %.

34. The alloy in accordance with claim 28 wherein Mg is in the range of 0.2 to 2.0 wt. %.

35. The alloy in accordance with claim 28 wherein Zn is in the range of 0.2 to 2.0 wt. %.

36. The alloy in accordance with claim 28 wherein Zr is in the range of 0.05 to 0.12 wt. %.

37. The alloy in accordance with claim 28 wherein Cu is in the range of 2.55 to 2.90 wt. %.

38. A method of producing an unrecrystallized aluminum-lithium plate product having improved levels of strength, fracture toughness and corrosion resistance, the method comprising the steps of:

(a) providing a body of a lithium containing aluminum base alloy consisting essentially of 1.5 to 3.0 wt. % Li, 0.2 to 2.0 wt. % Mg, 2.55 to 2.90 wt. % Cu, 0.05 to 0.12 wt. % Zr, 0.2 to 2.0 wt. % Zn, 0.5 wt. % max. Fe, 0.5 wt. % max. Si, Mg and Zn maintained in a ratio in the range of 0.1 to less than 1, the balance aluminum and incidental impurities;

(b) heating the body to a hot working temperature;

(c) hot rolling the body to provide a plate product; and (d) solution heat treating, quenching and aging said product to provide a substantially unrecrystallized product having improved levels of strength and fracture toughness.

39. A method of producing an unrecrystallized aluminum-lithium plate product having improved levels of strength, fracture toughness and corrosion resistance, the method comprising the steps of:

(a) providing a body of a lithium containing aluminum base alloy consisting essentially of 1.8 to 2.5 wt. % Li, 0.2 to 2.0 wt. % Mg, 2.5 to 2.9 wt. % Cu, 0.08 to 0.12 wt. % Zr, 0.2 to 2.0 wt. % Zn, 0.5 wt. % max. Fe, 0.5 wt. % max. Si, Mg and Zn maintained in a ratio in the range of 0.1 to less than 1, the balance aluminum and incidental impurities;

(b) heating the body to a hot working temperature;

(c) hot rolling the body to provide a plate product; and (d) solution heat treating, quenching and aging said product to provide a substantially unrecrystallized product having improved levels of strength and fracture toughness.

40. A method of producing an unrecrystallized aluminum-lithium plate product having improved levels of strength, fracture toughness and corrosion resistance, the method comprising the steps of:

(a) providing a body of a lithium containing aluminum base alloy consisting essentially of 1.9 to 2.4 wt. % Li, 0.1 to 0.6 wt. % Mg, 2.5 to 3.0 wt. % Cu, 0.5 to 1.0 wt. % Zn, 0.5 wt. % max. Fe, 0.5 wt. % max. Si, at least one of the elements selected from the group Cr, V, Hf, Mn, Ti and Zr, with Cr, V, Ti and Zr in the range of 0.01 to 0.2 wt. % and Hf and Mn up to 0.6 wt. % each, mg and Zn maintained in a ratio in the range of 0.1 to less than 1, the balance aluminum and incidental impurities;

(b) heating the body to a hot working temperature;

(c) hot rolling the body to provide a plate product; and (d) solution heat treating, quenching and aging said product to provide a substantially unrecrystallized product having improved levels of strength and fracture toughness.

41. A method of producing a flat rolled product having improved levels of strength, fracture toughness and corrosion resistance, the method comprising the steps of:

(a) providing a body of a lithium containing aluminum base Cu, Mg, Zn alloy having Cu greater than 2.45 wt. %, having an Mg-Zn ratio of 0.1 to less than 1.0 when Mg is in the range of 0.1 to 1.0 wt. %;

(b) heating the body to a hot working temperature;

(c) hot rolling the body to provide a plate product; and (d) solution heat treating, quenching and aging said product to provide a substantially unrecrystallized product having improved levels of strength and fracture toughness, the product has a solid state plate-shaped precipitate in the family of 1,0,0 planes, the alloy product developing a number density of precipitates per cubic centimeter of at least $1.0\times10^{15}$ in an unstretched condition prior to aging and having a specific tensile yield strength of greater than $0.75\times10^{6}$ ksi $in^3/lb$.

42. A method of producing a flat rolled product having improved levels of strength, fracture toughness and corrosion resistance, the method comprising the steps of:

(a) providing a body of a lithium containing aluminum base Cu, Mg, Zn alloy product having improved combinations of strength and fracture toughness, the alloy consisting essentially of 0.2 to 5.0 wt. % Li, 0.05 to 2.0 wt. % Mg, at least 2.45 wt. % Cu, 0.01 to 0.16 wt. % Zr, 0.05 to 2.0 wt. % Zn, 0.5 wt. % max. Fe, 0.5 wt. % max. Si, Mg and Zn maintained in a ratio in the range of 0.1 to less than 1, the balance aluminum and incidental impurities;

(b) heating the body to a hot working temperature;

(c) hot rolling the body to provide a plate product; and (d) solution heat treating, quenching and aging said product to provide a substantially unrecrystallized product having improved levels of strength and fracture toughness, the product has a solid state plate-shaped precipitate in the family of 1,0,0 planes, the alloy product developing a number density of precipitates per cubic centimeter in the range of $1\times10^{16}$ to $5.6\times10^{16}$ and having a specific tensile yield strength of greater than $0.8\times10^{6}$ ksi $in^3/lb$.

43. A method of producing a flat rolled product having improved levels of strength, fracture toughness and corrosion resistance, the method comprising the steps of:

(a) providing a body of a lithium containing aluminum base Cu, Mg, Zn alloy product having improved combinations of strength and fracture toughness, the alloy consisting essentially of 1.9 to 2.4 wt. % Li, 0.1 to 0.6 wt. % Mg, 2.5 to 3.0 wt. % Cu, 0.08 to 0.12 wt. % Zr, 0.5 to 1.0 wt. % Zn, 0.5 wt. % max. Fe, 0.5 wt. % max. Si, Mg and Zn maintained in a ratio in the range of 0.1 to less than 1, the balance aluminum and incidental impurities;

(b) heating the body to a hot working temperature;

(c) hot rolling the body to provide a plate product; and (d) solution heat treating, quenching and aging said product to provide a substantially unrecrystallized product having improved levels of strength and fracture toughness, the product has a solid state plate-shaped precipitate in the family of 1,0,0 planes, the alloy product developing a number density of precipitates per cubic centimeter in the range of $1\times10^{16}$ to $5.6\times10^{16}$ and having a specific tensile yield strength of greater than $0.8\times10^{6}$ ksi $in^3/lb$.

44. A method of producing a recrystallized aluminum-lithium plate product having improved levels of strength and fracture toughness, the method comprising the steps of:

(a) providing a body of a lithium containing aluminum base alloy consisting essentially of 0.2 to 5.0 wt. % Li, 0.05 to 2.0 wt. % Mg, at least 2.45 wt. % Cu, 0.05 to 2.0 wt. % Zn, 0.5 wt. % max. Fe, 0.5 wt. % max. Si, at least one of the elements selected from the group Cr, V, Hf, Mn, Ti and Zr, with Cr, V, Ti and Zr in the range of 0.01 to 0.2 wt. % and Hf and Mn up to 0.6 wt. % each, Mg and Zn maintained in a ratio in the range of 0.1 to less than 1, the balance aluminum and incidental impurities;

(b) heating the body to a hot working temperature in the range of 800° to 1000° F.;

(c) hot rolling the body to provide said plate product; and (d) solution heat treating, quenching and aging said product to provide a recrystallized plate product having improved levels of strength and fracture toughness.

45. The method in accordance with claim 44 wherein hot rolling is performed at a temperature in the range of 800° to 850° F.

46. A method of producing a recrystallized aluminum-lithium sheet product having improved levels of strength, fracture toughness an d corrosion resistance, the method comprising the steps of:

(a) providing a body of a lithium containing aluminum base alloy consisting essentially of 0.2 to 5.0 wt. % Li, 0.05 to 2.0 wt. % Mg, at least 2.45 wt. % Cu, 0.05 to 0.15 wt. % Zr, 0.05 to 2.0 wt. % Zn, 0.5 wt. % max. Fe, 0.5 wt. % max. Si, Mg and Zn maintained in a ratio in the range of 0.1 to less than 1, the balance aluminum and incidental impurities;

(b) heating the body to a hot working temperature in the range of 800° to 1000° F.;

(c) hot rolling the body to provide a first product;

(d) annealing said first product;

(e) cold rolling said first product to a second wrought product to achieve at least a 25% reduction in gauge to provide a sheet product; and (f) solution heat treating, quenching and aging said product to provide a substantially unrecrystallized sheet product having improved levels of strength and fracture toughness.

47. The method in accordance with claim 46 wherein annealing is performed at a temperature in the range of 800° to 850° F.

48. The method in accordance with claim 46 wherein solution heat treating is performed at a temperature in the range of 950° to 1020° F. with a heat-up rate of not lower than 10° F./min.

49. The method in accordance with claim 46 wherein solution heat treating is performed at a temperature in the range of 950° to 1020° F. with a heat-up rate of not lower than 200° F./min.

50. The alloy in accordance with claim 46 wherein Li is in the range of 1.5 to 3.0 wt. %.

51. The alloy in accordance with claim 46 wherein Li is in the range of 1.8 to 2.5 wt. %.

52. The alloy in accordance with claim 46 wherein Mg is in the range of 0.2 to 2.0 wt. %.

53. The alloy in accordance with claim 46 wherein Zn is in the range of 0.2 to 2.0 wt. %.

54. The alloy in accordance with claim 46 wherein Zr is in the range of 0.05 to 0.12 wt. %.

55. The alloy in accordance with claim 46 wherein Cu is in the range of 2.55 to 2.90 wt. %.

56. A method of producing a recrystallized aluminum-lithium sheet product having improved levels of strength, fracture toughness and corrosion resistance, the method comprising the steps of:

(a) providing a body of a lithium containing aluminum base alloy consisting esentially of 1.9 to 2.4 wt. % Li, 0.1 to 0.6 wt. % Mg, 2.5 to 3.0 wt. % Cu, 0.08 to 0.12 wt. % Zr, 0.5 to 1.0 wt. % Zn, 0.5 wt. % max. Fe, 0.5 wt. % max. Si, Mg and Zn maintained in a ratio in the range of 0.1 to less than 1, the balance aluminum and incidental impurities;

(b) heating the body to a hot working temperature in the range of 800° to 1000° F.;

(c) hot rolling the body to provide a first product;

(d) annealing said first product;

(e) cold rolling said first product to a second wrought product to achieve at least a 25% reduction in gauge to provide a sheet product; and (f) solution heat treating, quenching an aging said product to provide a substantially unrecrystallized sheet product having improved levels of strength and fracture toughness.

* * * * *

UNITED STATES PATENT AND TRADEMARK OFFICE

CERTIFICATE OF CORRECTION

PATENT NO. : 5,137,686

DATED : August 11, 1992

INVENTOR(S) : Roberto J. Rioja et al

It is certified that error appears in the above-identified patent and that said Letters Patent is hereby corrected as shown below:

| | |
|---|---|
| Col. 1, line 55 | Change "4,582,254" to --4,582,544-- |
| Col. 2, line 36 | After "Li," change "0.05" to --0.5-- |
| Col. 3, line 59 | Change "side" to --aids-- |
| Col. 4, lines 9-10 | After "content is", change "being" to --about-- |
| Col. 4, line 24 | After "resistance", insert --to-- |
| Col. 4, line 38 | Change "2 to 3" to --2 or 3-- |
| Col. 4, line 40 | Change "consolidation" to --consolidated-- |
| Col. 5, lines 27-28 | After "In", change "bath" to --batch-- |
| Col. 5, line 33 | Change "bath" to --batch-- |
| Col. 5, line 64 | Change "ksi in" to --ksi√in-- |
| Col. 6, line 7 | After "steps," change "ar" to --are-- |
| Col. 6, line 58 | Change "product" to --products-- |
| Col. 9-10, Table 5 | Under the heading "Aged 25 hr. at 350°F.", across from Alloy G (1st occurrence), change "5.0" to --6.0-- |

UNITED STATES PATENT AND TRADEMARK OFFICE

CERTIFICATE OF CORRECTION

PATENT NO. : 5,137,686

DATED : August 11, 1992

INVENTOR(S) : Roberto J. Rioja et al

It is certified that error appears in the above-identified patent and that said Letters Patent is hereby corrected as shown below:

Col. 11-12, Table 7 Headings should include symbols † and ‡ where shown as follows:

| | Plate (1" Thick) Tensile Properties at 6% Stretch | | | | | | | | | | | |
|---|---|---|---|---|---|---|---|---|---|---|---|---|
| | Aged 15 hr. at 325° F. | | | | Aged 20 hr. at 325° F. | | | | Aged 25 hr. at 325° F. | | | |
| Alloy | Tensile Yield Strength † | Ultimate Tensile Strength † | % Elongation | Fracture Toughness ‡ | Tensile Yield Strength † | Ultimate Tensile Strength † | % Elongation | Fracture Toughness ‡ | Tensile Yield Strength † | Ultimate Tensile Strength † | % Elongation | Fracture Toughness ‡ |

Col. 13, line 53, Change "0.2 to 2.9 wt.% Mg" to --0.2 to 2.0 wt.% Mg--.

Signed and Sealed this

Twenty-sixth Day of April, 1994

Bruce Lehman

*Attest:*

BRUCE LEHMAN

*Attesting Officer*

*Commissioner of Patents and Trademarks*